US005683845A

United States Patent [19]

Sata et al.

[11] Patent Number: 5,683,845

[45] Date of Patent: Nov. 4, 1997

[54] POSITIVELY CHARGEABLE TONER FOR NONMAGNETIC ONE-COMPONENT DEVELOPING METHOD

[75] Inventors: Shin-ichi Sata; Jun Shimizu; Masayuki Maruta, all of Wakayama, Japan

[73] Assignee: KAO Corporation, Tokyo, Japan

[21] Appl. No.: 744,818

[22] Filed: Nov. 6, 1996

[30] Foreign Application Priority Data

Nov. 6, 1995 [JP] Japan ..... 7-313608

[51] Int. Cl.[6] ..... G03G 9/097

[52] U.S. Cl. ..... 430/110; 430/903

[58] Field of Search ..... 430/110, 109, 430/106

[56] References Cited

U.S. PATENT DOCUMENTS 4,175,167 11/1979 van Lier ..... 429/59

4,804,622 2/1989 Tanaka et al. ..... 430/107

OTHER PUBLICATIONS

JP–A–62–195676 (English Abstract only).

JP–A–62–195677 (English Abstract only).

JP–A–62–195678 (English Abstract only).

JP–A–62–195679 (English Abstract only).

JP–A–62–195680 (English Abstract only).

*Primary Examiner*—John Goodrow

*Attorney, Agent, or Firm*—Birch, Stewart, Kolasch & Birch, LLP

[57] ABSTRACT

The positively chargeable toner used for a nonmagnetic one-component developing method includes a toner particle and fine polytetrafluoroethylene particles, the toner particle having (a) a binder resin having a polyester resin having an acid value of 10 mg KOH/g or less; (b) a colorant; and (c) a charge control agent, and the fine polytetrafluoroethylene particles, whose average primary particle size is at least 0.05 μm and less than 0.5 μm, being externally added to the surface of the toner particle. The nonmagnetic one-component developing method includes the step of loading the above positively chargeable toner in a developer device for a nonmagnetic one-component toner.

10 Claims, No Drawings

POSITIVELY CHARGEABLE TONER FOR NONMAGNETIC ONE-COMPONENT DEVELOPING METHOD

BACKGROUND OF THE INVENTION

1. Field of the Invention

The present invention relates to a positively chargeable toner used for development of electrostatic latent images in electrophotography, electrostatic printing, and electrostatic recordings, particularly used for development of electrostatic latent images formed by nonmagnetic one-component development.

2. Discussion of the Related Art

Conventionally, developing methods utilizing such methods as electrophotography include two-component developing methods using a developer comprising a magnetic carrier and a toner, and one-component developing methods containing no magnetic carrier. The one-component developing methods can be further classified into magnetic one-component developing methods and nonmagnetic one-component developing methods depending upon whether or not a magnetic material is contained in the toner.

Among the above developing methods, two-component magnetic brush developing methods using a developer consisting of two components, namely, a toner and a carrier, have been mainly used conventionally, the carrier being used for the purposes of supplying electric charges to the toner and of conveying the charged toner onto the electrostatic latent image portion by a magnetic force. However, in the two-component magnetic brush developing method, since a magnetic force is utilized in the conveying of the developer, a magnet has to be placed in the inner portion of the developer roller, and the carrier is made of a metal or an oxide thereof such as iron powder and ferrite. Therefore, the developer device and the developer become undesirably heavy, thereby making it difficult to miniaturize and thus reduce the weight of the overall recording device.

Also, as disclosed in U.S. Pat. Nos. 3,909,258 and 4,121,931, there have been conventionally well used magnetic one-component developing methods comprising the step of conveying a toner to the electrostatic latent image portion without using a carrier, the methods being carried out by utilizing a magnetic force owned by the toner containing a magnetic material therein. However, a magnet has to be also placed in the inner portion of the developer roller in this developing method, making it disadvantageous from the aspect of weight reduction of the developer device. Also, since the magnetic material is contained in the inner portion of the toner, it is practically impossible to be used as color toners.

In order to solve the problems in these developing methods, much studies have been recently conducted on nonmagnetic one-component developing methods wherein a toner alone is used without containing any magnetic powder, as disclosed, for instance, in U.S. Pat. Nos. 2,895,847 and 3,152,012, and Japanese Patent Examined Publication Nos. 41-9475, 45-2877, and 54-3624.

On the other hand, the photoconductors which are used in the above developing methods include organic and inorganic photoconductors, which are further classified into positively charged ones and negatively charged ones depending upon its polarity. Among them, the organic photoconductors have been widely used as photoconductors for copy machines and printers because of their superior properties in productivity, environmental stability, and machinability, as compared to those of the inorganic photoconductors.

However, in the function-separation type organic photoconductors which have been in practical use so far, since hole transport materials are used in CTL, these organic photoconductors have been negatively charged types. Therefore, a large amount of ozone is generated by negative corona discharge, thereby causing such problems as requiring equipments for ozone treatment apparatus and deteriorating the surface of the photoconductor drum. In view of these problems, the development for positively charged organic photoconductors has been made, some of which are presently in practical use.

However, since the positively charged organic photoconductors have low sensitivity when compared with the conventionally used inorganic photoconductors, such as selenium-based photoconductors, the following problems newly arise in the design of the toner used. In other words, the term "the sensitivity of the photoconductor is low" means that in a case of a reverse development, for instance, even higher development bias voltage has to be applied for obtaining the same image density, which results in a smaller potential difference between the surface voltage of the unexposed portion and the developing bias voltage than that of the inorganic photoconductor, thereby generating much background. Further, since the organic photoconductors have poorer surface strength than that of the inorganic photoconductors, the durability of the organic photoconductor is low. Therefore, it has been necessary to make the life of the organic photoconductor longer.

On the other hand, as for binder resin for toners, various resins, including styrenic copolymers, such as polystyrenes, styrene-butadiene copolymers, and styrene-acrylic copolymers; ethylenic copolymers, such as polyethylenes and ethylene-vinyl acetate copolymers; poly(meth)acrylic acid esters; polyester resins; epoxy resins; and polyamide resins, have been used. Among these resins, the polyester resins are particularly used as resins for toners having excellent low-temperature fixing ability. Also, the polyester resins inherently have good resin toughness, so that the durability of the resin can be improved while retaining the low-temperature fixing ability, and thus making them suitable for nonmagnetic one-component toner wherein a stress is more liable to be exerted on a toner by a charging blade.

An object of the present invention is to provide a positively chargeable toner used for a nonmagnetic one-component developing method.

Another object of the present invention is to provide a nonmagnetic one-component developing method using the above positively chargeable toner.

These and other objects of the present invention will be apparent from the following description.

SUMMARY OF THE INVENTION

As a result of intensive research in view of the above problems, the present inventors have found that the above problems can be solved by using a positively chargeable toner used for a nonmagnetic one-component developing method, comprising fine polytetrafluoroethylene particles having a particular particle size and a toner particle comprising a polyester resin having an acid value of 10 mg KOH/g or less as a binder resin, the fine polytetrafluoroethylene particles being externally added to the surface of the toner particle. The present invention has been completed based upon these findings.

In one aspect, the present invention is concerned with a positively chargeable toner used for a nonmagnetic one-component developing method, comprising a toner particle and fine polytetrafluoroethylene particles, the toner particle comprising:

(a) a binder resin comprising a polyester resin having an acid value of 10 mg KOH/g or less;

(b) a colorant; and (c) a charge control agent, and the fine polytetrafluoroethylene particles, whose average primary particle size is at least 0.05 μm and less than 0.5 μm, being externally added to the surface of the toner particle.

In another aspect, the present invention is concerned with a nonmagnetic one-component developing method comprising the step of loading the above positively chargeable toner in a developer device for a nonmagnetic one-component toner.

DETAILED DESCRIPTION OF THE INVENTION

The positively chargeable toner used for a nonmagnetic one-component developing method, comprises a toner particle and fine polytetrafluoroethylene particles, the toner particle comprising:

(a) a binder resin comprising a polyester resin having an acid value of 10 mg KOH/g or less;

(b) a colorant; and (c) a charge control agent, and the fine polytetrafluoroethylene particles whose average primary particle size is at least 0.05 μm and less than 0.5 μm being externally added to the surface of the toner particle.

The average primary particle size of the fine polytetrafluoroethylene particles is 0.05 μm or more and less than 0.5 μm, preferably from 0.1 to 0.45 μm, more preferably from 0.15 to 0.4 μm. When the average primary particle size of the fine polytetrafluoroethylene particles is 0.05 or more, the fine polytetrafluoroethylene particles being externally added to the surface of the toner particle are not likely to be embedded in the toner particle during continuous printing, thereby maintaining the advantageous effects of the present invention. On the other hand, when the average primary particle size is less than 0.5, the fine polytetrafluoroethylene particles are not easily detached from the toners, thereby making it possible to achieved the effects of the present invention. Here, the average primary particle size of the fine polytetrafluoroethylene particles is obtained by calculating a number-average of the primary particle size obtained by taking measurements from an electron micrograph.

More specifically, the fine polytetrafluoroethylene particles used herein include those having nearly spherical shapes produced by emulsification polymerization. Examples thereof may be those which are commercially available, including "KTL-500F" (manufactured by Kitamura, whose average primary particle size is 0.3 μm); "LUBRON L2" (manufactured by Daikin Industries, Ltd., whose average primary particle size is 0.3 μm); LUBRON L5" (manufactured by Daikin Industries, Ltd., whose average primary particle size is 0.2 μm); "FLUON LUBRICANT L170J" (manufactured by Asahi ICI Fluoropolymers, whose average primary particle size is 0.1 μm); "FLUON LUBRICANT L172J" (manufactured by Asahi ICI Fluoropolymers, whose average primary particle size is 0.1 μm); "MP-1100" (manufactured by Mitsui-Dupont Fluorochemicals, whose average primary particle size is 0.2 μm); "MP-1200" (manufactured by Mitsui-Dupont Fluorochemicals, whose average primary particle size is 0.3 μm); and "TLP-10F-l" (manufactured by Mitsui-Dupont Fluorochemicals, whose average primary particle size is 0.2 μm).

The amount of the fine polytetrafluoroethylene particles is preferably from 0.01 to 1.5 parts by weight, more preferably from 0.05 to 1.0 part by weight, based on 100 parts by weight of the toner particle. The amount of the fine polytetrafluoroethylene particles is preferably from 0.1 to 1.5 parts by weight or less from the viewpoint of having good flowability and conveyability of the toners, thereby maintaining good image density, and also making it possible to prevent background on the formed images and background on the photoconductors.

In the present invention, the fine polytetrafluoroethylene particles are used for the following reasons. The fine polytetrafluoroethylene particles themselves have a larger negative chargeability by triboelectric charging when compared with other fluororesins, such as poly(vinylidene fluoride) plastics, so that good triboelectric charging of the resulting toner can be achieved during blending before passing the toners through the charging blade or while passing the toners through the charging blade. Also, since the melting point of the polytetrafluoroethylene is high and the coefficient of friction is low, the abrasion of the photoconductor at the cleaning portion can be notably reduced, so that the toners are not liable to be melt-fused to the photoconductor, thereby making the life of the photoconductor longer.

The methods for externally adding the above fine polytetrafluoroethylene particles to the surface of the toner particle are not particularly limited as long as they allow to adhere the fine polytetrafluoroethylene particles to the surface of the toner particle, and any of known methods may be employed, including those blending methods using Henschel mixers, microspeed mixers, and super mixers.

The positively chargeable toners of the present invention comprises a binder resin, a colorant, and a charge control agent, which may optionally comprise offset inhibitors and other additives.

The binder resins usable in the present invention are polyester resins having an acid value of 10 mg KOH/g or less, preferably those having an acid value of from 0 to 6 mg KOH/g. The acid value is preferably 10 mg KOH/g or less from the viewpoint of alleviating the negative chargeability of the resin itself, so that the resin can be suitably used for a positively chargeable toner of the present invention.

The acid value of the polyester resins may be controlled to a level of 10 mg KOH/g or less by such a method comprising adjusting the ratio between alcohol components and carboxylic acid components during the polyester production in a system rich in alcohol components, or a method comprising carrying out the condensation reaction until all of the carboxylic acids are polymerized.

The polyester resins can be obtained by the condensation polymerization of polyhydric alcohol components and polycarboxylic acid components, namely the condensation polymerization between a polyhydric alcohol and a polycarboxylic acid, a polycarboxylic acid anhydride or a polycarboxylic ester.

Among the alcohol components, the diol components may be those represented by the following general formula (I):

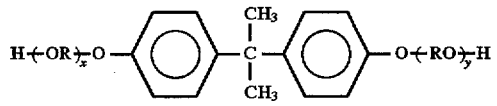

(I)

wherein R stands for an ethylene group or a propylene group;. and x and y independently stand for integers of 1 or more, wherein an average sum of x and y is from 2 to 7.

Examples thereof include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane.

In addition, in certain cases, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, propylene adducts of bisphenol A, ethylene adducts of bisphenol A, and other dihydric alcohols may be also added.

Examples of the trihydric or higher polyhydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohols.

Among these alcohols, polyoxypropylene(2.2)-2,2-bis(4-hydroxyphenyl)propane and polyoxyethylene(2.0)-2,2-bis(4-hydroxyphenyl)propane are preferably used.

In the present invention, these dihydric alcohol monomers and trihydric or higher polyhydric alcohol monomers may be used singly or in combination.

The polycarboxylic acids, the polycarboxylic acid anhydrides, and the polycarboxylic esters, include the following.

As for the acid components, examples of the dicarboxylic acid components include maleic acid, fumaric acid, citraconic acid, iraconic acid, glutaconic acid, phthalic acid, isophthalic acid, terephthalic acid, cyclohexanedicarboxylic acid, succinic acid, adipic acid, sebacic acid, azelaic acid, and malonic acid; and alkylsuccinic or alkenylsuccinic acids, such as n-butylsuccinic acid, n-butenylsuccinic acid, isobutylsuccinic acid, isobutenylsuccinic acid, n-octylsuccinic acid, n-octenylsuccinic acid, isooctylsuccinic acid, isooctenylsuccinic acid, n-dodecylsuccinic acid, n-dodecenylsuccinic acid, isododecylsuccinic acid, and isododecenyl-succinic acid. Also, acid anhydrides of these dicarboxylic acids, lower alkyl esters thereof, and other dicarboxylic acid components are also included.

Examples of the tricarboxylic or higher polycarboxylic acid components include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof, lower alkyl esters thereof, and other tricarboxylic or higher polycarboxylic acid components.

In the present invention, these dicarboxylic acid monomers and trihydric or higher polycarboxylic acid monomers may be used singly or in combination.

In addition, examples of polycarboxylic acids include a tetracarboxylic acid having the following general formula (II):

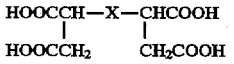

$$\begin{array}{l} HOOCCH-X-CHCOOH \\ \quad\;\; | \qquad\qquad\;\; | \\ HOOCCH_2 \qquad CH_2COOH \end{array} \qquad (II)$$

wherein X stands for an alkylene group or an alkenylene group, each having from 5 to 30 carbon atoms and having one or more side chains each with 3 or more carbon atoms.

Examples thereof include the following items (1) to (12):

(1) 4-Neopentylidenyl-1,2,6,7-heptanetetracarboxylic acid;

(2) 4-Neopentyl-1,2,6,7-heptene(4)-tetracarboxylic acid;

(3) 3-Methyl-4-heptenyl-1,2,5,6-hexanetetracarboxylic acid;

(4) 3-Methyl-3-heptyl-5-methyl-1,2,6,7-heptene(4)-tetracarboxylic acid;

(5) 3-Nonyl-4-methyldenyl-1,2,5,6-hexanetetracarboxylic acid;

(6) 3-Decylidenyl-1,2,5,6-hexanetetracarboxylic acid;

(7) 3-Nonyl-1,2,6,7-heptene(4)-tetracarboxylic acid;

(8) 3-Decenyl-1,2,5,6-hexanetetracarboxylic acid;

(9) 3-Butyl-3-ethylenyl-1,2,5,6-hexanetetracarboxylic acid;

(10) 3-Methyl-4-butylidenyl-1,2,6,7-heptanetetracarboxylic acid;

(11) 3-Methyl-4-butyl-1,2,6,7-heptene(4)-tetracarboxylic acid; and

(12) 3-Methyl-5-octyl-1,2,6,7-heptene(4)-tetracarboxylic acid.

The polyester resins in the present invention are obtainable by carrying out condensation polymerization of the above polyhydric alcohol components and the polycarboxylic acid components. For instance, the condensation polymerization may be carried out at a temperature of from 180 to 250° C. in an inert gas atmosphere. In order to accelerate the above reaction, conventionally used esterification catalysts, such as zinc oxide, tin (II) oxide, dibutyltin oxide, and dibutyltin dilaurate, may be used. To achieve the same purpose, the polyester resins may be prepared under a reduced pressure.

Examples of the polyester resins produced by the methods described above are those having an acid value of 10 mg KOH/g or less, of the polyesters disclosed in Japanese Patent Laid-Open Nos. 62-195676, 62-195677, 62-195678, 62-195679, and 62-195680.

Among them, the polyesters obtainable by condensation polymerization of polycarboxylic acid components other than aromatic polycarboxylic acid components and polyhydric alcohols are preferably used as the binder resins of the present invention. This is because the acid strength of the polycarboxylic acid components other than the aromatic polycarboxylic acid components is lower and its pKa, wherein Ka is a dissociation constant, is smaller than those of the aromatic polycarboxylic acids.

Among the polycarboxylic acid components listed above, examples of the polycarboxylic acid components other than aromatic polycarboxylic acid components include dicarboxylic acids, such as maleic acid, fumaric acid, and alkylsuccinic and alkenylsuccinic acids; tricarboxylic acids, such as trimellitic acid, 1,2,4-butanetricarboxylic acid and 1,2,5-hexanetricarboxylic acid; and tetracarboxylic acids, such as 1,2,7,8-octanetetracarboxylic acid and tetracarboxylic acids having the general formula (II), acid anhydrides thereof, and lower alkyl esters thereof whose alkyl moieties have 1 to 4 carbon atoms.

Among them, in particular, trimellitic acid or a derivative thereof is preferably used because it is inexpensive and the reaction control is easy.

Examples of the colorants used in the present invention include carbon black; inorganic pigments, such as iron black; acetoacetic arylamide-based monoazo yellow pigments, such as C.I. Pigment Yellow 1, C.I. Pigment Yellow 3, C.I. Pigment Yellow 74, C.I. Pigment Yellow 97, and C.I. Pigment Yellow 98; acetoacetic arylamide-based bisazo yellow pigments, such as C.I. Pigment Yellow 12, C.I. Pigment Yellow 13, C.I. Pigment Yellow 14, and C.I Pigment Yellow 17; yellow dyes, such as C.I. Solvent Yellow 19, C.I. Solvent Yellow 77, C.I. Solvent Yellow 79, and C.I. Disperse Yellow 164; red or crimson pigments, such as C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Red 122, and C.I. Pigment Red 5; red dyes, such as C.I. Solvent Red 49, C.I. Solvent Red 52, C.I Solvent Red 58, and C.I. Solvent Red 8; blue pigments and dyes of copper phthalocyanine, such as C.I. Pigment Blue 15:3, and derivatives thereof; green pigments, such as C.I. Pigment Green 7 and C.I. Pigment Green 36 (Phthalocyanine Green). These pigments or dyes may be used alone or in combination. These pigments or dyes are preferably added in an amount of from about 1 to 15 parts by weight, based on 100 parts by weight of the binder resin.

The charge control agents usable in the present invention are one or more of the positive charge control agents which are conventionally used in electrophotography. Examples thereof include nigrosine dyes such as "BONTRON N-01" (manufactured by Orient Chemical), "BONTRON N-07" (manufactured by Orient Chemical), "BONTRON N-09" (manufactured by Orient Chemical), and "BONTRON N-04" (manufactured by Orient Chemical); triphenylmethane derivatives, such as "COPY BLUE PR" (manufactured by Hoechst); quaternary ammonium salt compounds such as "TP-415" (manufactured by Hodogaya Chemical), "COPY CHARGE PSY" (manufactured by Hoechst), "BONTRON P-51" (manufactured by Orient Chemical), cetyltrimethylammonium bromide; polyamine resins such as "BONTRON P-52" (manufactured by Orient Chemical), with a preference given to BONTRON N-07.

The above charge control agents may be added the binder resin in an amount of 0.1 to 8.0 parts by weight, preferably 0.2 to 5.0 parts by weight, based on 100 parts by weight of the binder resin.

The offset inhibitors which are optionally added in the present invention include waxes, such as polyolefins.

The positively chargeable toners for a nonmagnetic one-component developing method can be prepared by any of conventionally known methods without particular limitation. For instance, examples thereof include the methods comprising kneading, powdering, and classifying; and the methods for directly preparing the toners comprising suspending in an aqueous dispersing medium, a polymerizable composition comprising polymerizable monomers, polymerization initiators, colorants, and charge control agents, and polymerizing the monomeric components. The resulting untreated toners are subjected to a surface-treatment by externally adding the fine polytetrafluoroethylene particles by the methods described above. In the above methods, property improvers, such as free flow agents and cleanability improvers, may be optionally added.

Examples of the free flow agents include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride, with a preference given to finely powdered silica.

The finely powdered silica is a fine powder having Si-O-Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil, and silicone oil having amine in the side chain thereof can be used.

The cleanability improvers include fine powders of metal salts of higher fatty acids typically exemplified by zinc stearate.

The positively chargeable toner of the present invention is usable in a nonmagnetic one-component developing method. In particular, the effects of the present invention become more remarkably noted by utilizing the nonmagnetic one-component developing methods using positively charged organic photoconductors.

The positively chargeable toner of the present invention gives little background on the photoconductors even when the organic photoconductors are used in a case of utilizing nonmagnetic one-component developing methods, thereby increasing the durability of the photoconductor. Therefore, by using the positively chargeable toner of the present invention, excellent image quality, fixing ability, and durability can be achieved in the formed images.

EXAMPLES

The present invention is hereinafter described in more detail by means of the following resin production example, examples, and comparative examples, without intending to limit the scope of the present invention thereto. Here, the glass transition temperature (Tg) of the resin was measured by a differential scanning calorimeter under the following conditions.

Specifically, the glass transition temperature refers to the temperature of an intersection of the extension of the baseline of not more than the glass transition temperature and the tangential line showing the maximum inclination between the kickoff of the peak and the top thereof as determined with a sample using a differential scanning calorimeter ("DSC Model 210," manufactured by Seiko Instruments, Inc.), at a heating rate of 10° C./min. The sample is treated before measurement using the DSC by raising its temperature 100° C., keeping at 100° C. for 3 minutes, and cooling the hot sample at a cooling rate of 10° C./min. to room temperature. The acid value was measured by the method according to JIS K0070.

Preparation Example 1 (Preparation of Binder Resin A)

Three-thousand and five-hundred grams of polyoxypropylene(2.2)-2,2-bis(4-hydroxyphenyl)propane, 50 g of isododecenylsuccinic acid anhydride, 1110 g of fumaric acid, 2.5 g of hydroquinone, and 5 g of dibutyltin oxide were placed in a ten-liter four-neck glass flask equipped with a thermometer, a stainless steel stirring rod, a reflux condenser, and a nitrogen inlet tube. The contents were allowed to react with one another at 210° C. in a mantle heater in a nitrogen gas stream while stirring the contents.

The degree of polymerization was monitored from a softening point measured by the method according to ASTM E 28–67, and the reaction was terminated when the softening point reached 115° C.

The resulting resin had a glass transition temperature (Tg) with a single peak at 60° C. Also, the resin had an acid value of 6 KOH mg/g.

This resin is referred to as "Binder Resin A."

Preparation Example 2 (Preparation of Binder Resin B).

Two-thousand six-hundred and thirty grams of polyoxypropylene(2.2)-2,2-bis(4-hydroxyphenyl)propane, 1050 g of polyoxyethylene(2.0)-2,2-bis(4-hydroxyphenyl) propane, 970 g of terephthalic acid, 335 g of isododecenylsuccinic acid anhydride, 310 g of trimellitic acid, and 13 g of dibutyltin oxide were placed in a ten-liter four-neck glass flask equipped with a thermometer, a stainless steel stirring rod, a reflux condenser, and a nitrogen inlet tube. The contents were allowed to react with one another at 230° C. in a mantle heater in a nitrogen gas stream while stirring the contents.

The degree of polymerization was monitored from a softening point measured by the method according to ASTM E 28–67, and the reaction was terminated when the softening point reached 149° C.

The resulting resin had a glass transition temperature (Tg) with a single peak at 62° C. Also, the resin had an acid value of 6 KOH mg/g.

This resin is referred to as "Binder Resin B."

Preparation Example 3 (Preparation of Binder Resin C)

Two-thousand six-hundred and thirty grams of polyoxypropylene(2.2)-2,2-bis(4-hydroxyphenyl)propane, 1050 g of polyoxyethylene(2.0)-2,2-bis(4-hydroxyphenyl) propane, 1015 g of terephthalic acid, 335 g of isododecenylsuccinic acid anhydride, 310 g of trimellitic acid, and 13 g of dibutyltin oxide were placed in a ten-liter four-neck glass flask equipped with a thermometer, a stainless steel stirring rod, a reflux condenser, and a nitrogen inlet tube. The contents were allowed to react with one another at 230° C. in a mantle heater in a nitrogen gas stream while stirring the contents.

The degree of polymerization was monitored from a softening point measured by the method according to ASTM E 28–67, and the reaction was terminated when the softening point reached 150° C.

The resulting resin had a glass transition temperature (Tg) with a single peak at 65° C. Also, the resin had an acid value of 9 KOH mg/g.

This resin is referred to as "Binder Resin C."

Preparation Example 4 (Preparation of Binder Resin D)

Two-thousand six-hundred and thirty grams of polyoxypropylene(2.2)-2,2-bis(4-hydroxyphenyl)propane, 1050 g of polyoxyethylene(2.0)-2,2-bis(4-hydroxyphenyl) propane, 970 g of terephthalic acid, 480 g of isododecenylsuccinic acid anhydride, 310 g of trimellitic acid, and 13 g of dibutyltin oxide were placed in a ten-liter four-neck glass flask equipped with a thermometer, a stainless steel stirring rod, a reflux condenser, and a nitrogen inlet tube. The contents were allowed to react with one another at 230° C. in a mantle heater in a nitrogen gas stream while stirring the contents.

The degree of polymerization was monitored from a softening point measured by the method according to ASTM E 28–67, and the reaction was terminated when the softening point reached 145° C.

The resulting resin had a glass transition temperature (Tg) with a single peak at 60° C. Also, the resin had an acid value of 12 KOH mg/g.

This resin is referred to as "Binder Resin D," which is a comparative binder resin of the present invention.

Example 1

| | |
|---|---|
| Binder Resin A | 100 parts by weight |
| Carbon Black "REGAL 330R" (Manufactured by Cabot Corporation) | 4 parts by weight |
| Nigrosine Dye "BONTRON N-04" (Manufactured by Orient Chemical Co., Ltd.) | 4 parts by weight |
| Low-Molecular Weight Polypropylene Wax "MITSUI HIWAX NP-055," manufactured by Mitsui Petrochemical Industries, Ltd.) | 2 parts by weight |

The starting materials in the above proportions were blended well in advance, and then the mixture was kneaded using a twin-screw extruder heated at 100° C. The resulting mixture was cooled, and the cooled product was roughly pulverized, to a size of 2 mm-mesh pass by a mechanical pulverizer. Thereafter, the roughly pulverized mixture was finely powdered using a jet mill, and the resulting finely powdered mixture was classified using an air classifier, to give an untreated toner having an average particle size of 8.0 μm, the average particle size being D50 (volume) size distribution measured by a Coulter counter "MULTISIZER" (manufactured by COULTER Corporation). In the following examples, the average particle size was measured in the same manner as above. In Examples and Comparative Examples, the untreated toner means "toner particle" in the present invention.

To the surface of the untreated toner, 0.3 parts by weight of the fine PTFE (polyethylenetetrafluoroethylene) particles "KTL-500F" (manufactured by Kitamura) having an average primary particle size of 0.3 μm and 0.5 parts by weight of 20 nm-alumina subjected to a hydrophobic treatment with hexamethyldisilazane (BET specific surface area: 100 $m^2/g$; "TM-100," manufactured by Taimei Kagaku) were externally added. Thereafter, a toner was prepared by subjecting the untreated toner to a surface treatment by blending the fine particles together with the untreated toner using a Henschel mixer.

Here, the amounts of both PTFE and alumina were based on 100 parts by weight of the untreated toner.

Example 2

| | |
|---|---|
| Binder Resin B | 100 parts by weight |
| Carbon Black "REGAL 330R" (Manufactured by Cabot Corporation) | 4 parts by weight |
| Nigrosine Dye "BONTRON N-04" (Manufactured by Orient Chemical Co., Ltd.) | 4 parts by weight |
| Low-Molecular Weight Polypropylene Wax "MITSUI HIWAX NP-055," manufactured by Mitsui Petrochemical Industries, Ltd.) | 2 parts by weight |

The starting materials in the above proportions were blended well in advance, and then the mixture was kneaded using a twin-screw extruder heated at 100° C. The resulting mixture was cooled, and the cooled product was roughly pulverized, to a size of 2 mm-mesh pass by a mechanical pulverizer. Thereafter, the roughly pulverized mixture was finely powdered using a jet mill, and the resulting finely powdered mixture was classified using an air classifier, to give an untreated toner having an average particle size of 8.0 μm, the average particle size being D50 (volume) of size distribution measured by a Coulter counter.

To the surface of the untreated toner, 0.3 parts by weight of the fine PTFE particles "KTL-500F" (manufactured by Kitamura) having an average primary particle size of 0.3 μm and 0.5 parts by weight of 20 nm-alumina subjected to a hydrophobic treatment with hexamethyldisilazane (BET specific surface area: 100 $m^2/g$; "TM-100," manufactured by Taimei Kagaku) were externally added. Thereafter, a toner was prepared by subjecting the untreated toner to a surface treatment by blending the fine particles together with the untreated toner using a Henschel mixer.

Here, the amounts of both PTFE and alumina were based on 100 parts by weight of the untreated toner.

Example 3

| | |
|---|---|
| Binder Resin C | 100 parts by weight |
| Carbon Black "REGAL 330R" (Manufactured by Cabot Corporation) | 4 parts by weight |
| Nigrosine Dye "BONTRON N-04" (Manufactured by Orient Chemical Co., Ltd.) | 4 parts by weight |
| Low-Molecular Weight Polypropylene Wax "MITSUI HIWAX NP-055," manufactured by Mitsui Petrochemical Industries, Ltd.) | 2 parts by weight |

The starting materials in the above proportions were blended well in advance, and then the mixture was kneaded using a twin-screw extruder heated at 100° C. The resulting mixture was cooled, and the cooled product was roughly pulverized, to a size of 2 mm-mesh pass by a mechanical pulverizer. Thereafter, the roughly pulverized mixture was finely powdered using a jet mill, and the resulting finely powdered mixture was classified using an air classifier, to give an untreated toner having an average particle size of 8.0 μm, the average particle size being D50 (volume) of size distribution measured by a Coulter counter.

To the surface of the untreated toner, 0.3 parts by weight of the fine PTFE particles "KTL-500F" (manufactured by Kitamura) having an average primary particle size of 0.3 μm and 0.5 parts by weight of 20 nm-alumina subjected to a hydrophobic treatment with hexamethyldisilazane (BET specific surface area: 100 $m^2/g$; "TM-100," manufactured by Daimei Kagaku) were externally added. Thereafter, a toner was prepared by subjecting the untreated toner to a surface treatment by blending the fine particles together with the untreated toner using a Henschel mixer.

Here, the amounts of both PTFE and alumina were based on 100 parts by weight of the untreated toner.

Comparative Example 1

| | |
|---|---|
| Binder Resin D | 100 parts by weight |
| Carbon Black "REGAL 330R" (Manufactured by Cabot Corporation) | 4 parts by weight |
| Nigrosine Dye "BONTRON N-04" (Manufactured by Orient Chemical Co., Ltd.) | 4 parts by weight |
| Low-Molecular Weight Polypropylene Wax "MITSUI HIWAX NP-055," manufactured by Mitsui Petrochemical Industries, Ltd.) | 2 parts by weight |

The starting materials in the above proportions were blended well in advance, and then the mixture was kneaded using a twin-screw extruder heated at 100° C. The resulting mixture was cooled, and the cooled product was roughly pulverized, to a size of 2 mm-mesh pass by a mechanical pulverizer. Thereafter, the roughly pulverized mixture was finely powdered using a jet mill, and the resulting finely powdered mixture was classified using an air classifier, to give an untreated toner having an average particle size of 8.0 μm, the average particle size being D50 (volume) of size distribution measured by a Coulter counter.

To the surface of the untreated toner, 0.3 parts by weight of the fine PTFE particles "KTL-500F" (manufactured by Kitamura) having an average primary particle size of 0.3 μm and 0.5 parts by weight of 20 nm-alumina subjected to a hydrophobic treatment with hexamethyldisilazane (BET specific surface area: 100 $m^2/g$; "TM-100," manufactured by Taimei Kagaku) were externally added. Thereafter, a toner was prepared by subjecting the untreated toner to a surface treatment by blending the fine particles together with the untreated toner using a Henschel mixer.

Here, the amounts of both PTFE and alumina were based on 100 parts by weight of the untreated toner.

Comparative Example 2

| | |
|---|---|
| Binder Resin B | 100 parts by weight |
| Carbon Black "REGAL 330R" (Manufactured by Cabot Corporation) | 4 parts by weight |
| Nigrosine Dye "BONTRON N-04" (Manufactured by Orient Chemical Co., Ltd.) | 4 parts by weight |
| Low-Molecular Weight Polypropylene Wax "MITSUI HIWAX NP-055," manufactured by Mitsui Petrochemical Industries, Ltd.) | 2 parts by weight |

The starting materials in the above proportions were blended well in advance, and then the mixture was kneaded using a twin-screw extruder heated at 100° C. The resulting mixture was cooled, and the cooled product was roughly pulverized, to a size of 2 mm-mesh pass by a mechanical pulverizer. Thereafter, the roughly pulverized mixture was finely powdered using a jet mill, and the resulting finely powdered mixture was classified using an air classifier, to give an untreated toner having an average particle size of 8.0 μm, the average particle size being D50 (volume) of size distribution measured by a Coulter counter.

To the surface of the untreated toner, 0.5 parts by weight of 20 nm-alumina subjected to a hydrophobic treatment with hexamethyldisilazane (BET specific surface area: 100 $m^2/g$; "TM-100," manufactured by Taimei Kagaku) were externally added. Thereafter, a toner was prepared by subjecting the untreated toner to a surface treatment by blending the fine particles together with the untreated toner using a Henschel mixer.

Here, the amounts of the alumina were based on 100 parts by weight of the untreated toner.

Comparative Example 3

| | |
|---|---|
| Styrene/n-Butylmethacrylate (weight ratio: 65/35; weight-average molecular weight: 67000; Tg: 64° C.) | 100 parts by weight |
| Carbon Black "REGAL 330R" (Manufactured by Cabot Corporation) | 4 parts by weight |
| Nigrosine Dye "BONTRON N-04" (Manufactured by Orient Chemical Co., Ltd.) | 4 parts by weight |
| Low-Molecular Weight Polypropylene Wax "MITSUI HIWAX NP-055," manufactured by Mitsui Petrochemical Industries, Ltd.) | 2 parts by weight |

The starting materials in the above proportions were blended well in advance, and then the mixture was kneaded using a twin-screw extruder heated at 100° C. The resulting mixture was cooled, and the cooled product was roughly pulverized, to a size of 2 mm-mesh pass by a mechanical pulverizer. Thereafter, the roughly pulverized mixture was finely powdered using a jet mill, and the resulting finely powdered mixture was classified using an air classifier, to give an untreated toner having an average particle size of 8.0 μm, the average particle size being D50 (volume) of size distribution measured by a Coulter counter.

To the surface of the untreated toner, 0.3 parts by weight of the fine PTFE particles "KTL-500F" (manufactured by Kitamura) having an average primary particle size of 0.3 μm and 0.5 parts by weight of 20 nm-alumina subjected to a hydrophobic treatment with hexamethyldisilazane (BET specific surface area: 100 $m^2/g$; "TM-100," manufactured by Taimei Kagaku) were externally added. Thereafter, a toner was prepared by subjecting the untreated toner to a surface treatment by blending the fine particles together with the untreated toner using a Henschel mixer.

Here, the amounts of both PTFE and alumina were based on 100 parts by weight of the untreated toner.

Comparative Example 4

Similar procedures as in Example 2 were carried out except for externally adding fine polyvinylidene fluoride particles "KYNAR-461" (manufactured by PENNWALT) having an average primary particle size of 0.3 μm to the untreated toner in place of the fine PTFE particles "KTL-500F" having an average primary particle size of 0.3 μm, to prepare a toner.

Comparative Example 5

Similar procedures as in Example 2 were carried out except for externally adding fine styrene-methyl methacrylate copolymer particles "NK-32" (manufactured by Nippon Paint Co., Ltd.) having an average primary particle size of 0.080 μm to the untreated toner in place of the fine PTFE particles "KTL-500F" having an average primary particle size of 0.3 μm, to prepare a toner.

Test Example

Each of the toners prepared above as developers was loaded in a modified plain paper facsimile "TF-5500" (manufactured by Toshiba Corporation) whose photoconductor was changed to the following positively charged organic photoconductor (single-layered OPC), a surface voltage was +800 V, a developing bias voltage was +300 V, a supplying bias voltage was +400 V, and a transfer roller voltage was −1100 V, to evaluate the fixing ability of the toner and durability of the developer for 20000-sheet intermittent printing according to the evaluation standards given below.

The positively charged organic photoconductor used herein was a single-layered OPC wherein a fluorenone bisazo pigment and a tetraphenyldiamine (TPD) compound having the following formulas were applied on a substrate. Specifically, 5 parts by weight of the bisazo pigment and 100 parts by weight of the TPD were uniformly dispersed in 100 parts by weight of a polycarbonate resin, and the resulting mixture was applied on an aluminum substrate by a dip coating method so as to give a thickness, on a dry basis, of about 30 μm.

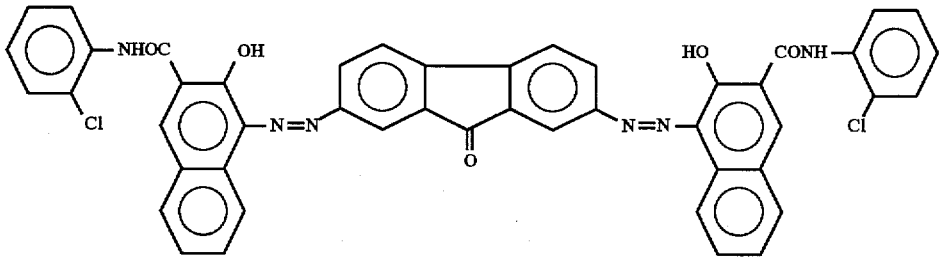

Fluorenone Bisazo Pigment

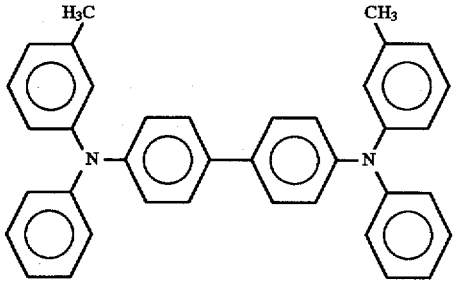

TPD (a) Image Quality:

Evaluated by gross examination, background on photoconductor, toner scattering, uneven formed images.

◎: Excellent;

○: Good;

Δ: Practically usable; and x: Not usable for practical purposes.

(b) Fixing Ability:

Evaluated by the lowest and highest non-offset values (non-offset region), and by the fastness test of the fixed images. Here, the practical range of the non-offset region was about 50° C. or more.

○: Good;

Δ: Practically usable; and x: Not usable for practical purposes.

(c) Durability:

Evaluated by testing the image quality of item (a) after a 20000-sheet intermittent printing with papers containing 5% dark portions, and also evaluated by gross examination the extent of deterioration of the photoconductor, the developer roller, and the developing blade.

○: Good;

Δ: Practically usable; and

X: Not usable for practical purposes.

The results are shown in Table 1.

TABLE 1

| | Image Quality | Fixing Ability | Durability |
|---|---|---|---|
| Examples | | | |
| 1 | ⊙ | O | O |
| 2 | O | O | O |
| 3 | O | O | O |
| Comparative Examples | | | |
| 1 | Δ | O | Δ |
| 2 | X | O | X |
| 3 | O | X | X |
| 4 | O | O | X |
| 5 | Δ | Δ | X |

As is shown in Table 1, in the cases of Example 1 to 3 where the positively chargeable toners of the present invention were used, the resulting toners were all good in image quality, the fixing ability, and the durability. In particular, in the case of Example 1 where the polyester used as a binder resin is prepared by condensation polymerization of the polycarboxylic acid component other than the aromatic polycarboxylic acid and the polyhydric alcohol, the resulting toner had remarkably excellent image quality.

By contrast, in the case of Comparative Example 2 where no fine PTFE particles were added for surface treatment, the resulting toner had notably poor image quality and durability. In the case of Comparative Example 4 where the fine polyvinylidene fluoride particles were added for surface treatment, the resulting toner had notably poor durability. In the case of Comparative. Example 5 where the fine styrene-methyl methacrylate copolymer particles were used for surface treatment, the resulting toner had slightly poor image quality and fixing ability, and also notably poor durability. In the case of Comparative Example 1 where an acid value exceeds 10 mg KOH/g, the resulting toner had slightly poor image quality and durability. In the case of Comparative Example 3 where a styrene-n-butyl methacrylate copolymer was used, the resulting toner had poor fixing ability and durability.

Here, excellent image quality can be obtained in the cases where the positively chargeable toners of the present invention were used primarily because the triboelectric charging of the toners can be well performed.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A positively chargeable toner used for a nonmagnetic one-component developing method, comprising a toner particle and fine polytetrafluoroethylene particles, said toner particle comprising:

(a) a binder resin comprising a polyester resin having an acid value of 10 mg KOH/g or less;

(b) a colorant; and (c) a charge control agent, and said fine polytetrafluoroethylene particles, whose average primary particle size is at least 0.05 μm and less than 0.5 μm, being adhered to the surface of said toner particle.

2. The positively chargeable toner according to claim 1, wherein said polyester resin is obtainable by carrying out condensation polymerization of a polycarboxylic acid component other than aromatic polycarboxylic acids and a polyhydric alcohol component.

3. The positively chargeable toner according to claim 1, wherein said fine polytetrafluoroethylene particles are externally added in an amount of from 0.01 to 1.5 parts by weight, based on 100 parts by weight of said toner particle.

4. The positively chargeable toner according to claim 2, wherein said polycarboxylic acid component is one or more compounds selected from the group consisting of maleic acid, fumaric acid, citraconic acid, iraconic acid, glutaconic acid, phthalic acid, isophthalic acid, terephthalic acid, cyclohexanedicarboxylic acid, succinic acid, adipic acid, sebacic acid, azelaic acid, malonic acid, n-butylsuccinic acid, n-butenylsuccinic acid, isobutylsuccinic acid, isobutenylsuccinic acid, n-octylsuccinic acid, n-octenylsuccinic acid, isooctylsuccinic acid, isooctenylsuccinic acid, n-dodecylsuccinic acid, n-dodecenylsuccinic acid, isododecylsuccinic acid, isododecenyl-succinic acid, acid anhydrides thereof, and lower alkyl esters thereof.

5. The positively chargeable toner according to claim 2, wherein said polycarboxylic acid component is one or more compounds selected from the group consisting of 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof, lower alkyl esters thereof.

6. The positively chargeable toner according to claim 2, wherein said polycarboxylic acid component is a tetracarboxylic acid having the following general formula (II):

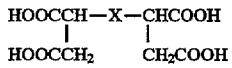

(II)

wherein X stands for an alkylene group or an alkenylene group, each having from 5 to 30 carbon atoms and having one or more side chains each with 3 carbon atoms or more.

7. The positively chargeable toner according to claim 2, wherein said polyhydric alcohol component comprises a diol component represented by the following general formula (I):

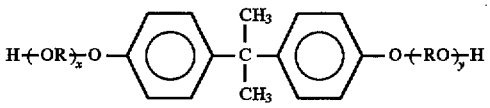

(I)

wherein R stands for an ethylene group or a propylene group; and x and y independently stand for integers of 1 or more, wherein an average sum of x and y is from 2 to 7.

8. The positively chargeable toner according to claim 1, wherein said charge control agent is added in an amount of 0.1 to 8.0 parts by weight, based on 100 parts by weight of the binder resin.

9. The positively chargeable toner according to claim 1, wherein the positively chargeable toner is employed in a nonmagnetic one-component developing method using a positively charged organic photoconductor.

10. A nonmagnetic one-component developing method comprising the step of loading the positively chargeable toner according to claim 1 in a developer device for a nonmagnetic one-component toner.

* * * * *